US008342962B2

(12) United States Patent
Lee et al.

(10) Patent No.: US 8,342,962 B2
(45) Date of Patent: Jan. 1, 2013

(54) ILLUMINATED INTERFACE DASHBOARD FOR GAMING MACHINE

(75) Inventors: Sigmund H. Lee, Atlanta, GA (US); Mark A. Thompson, Buford, GA (US)

(73) Assignee: Cadillac Jack, Duluth, GA (US)

( * ) Notice: Subject to any disclaimer, the term of this patent is extended or adjusted under 35 U.S.C. 154(b) by 806 days.

(21) Appl. No.: 12/014,872

(22) Filed: Jan. 16, 2008

(65) Prior Publication Data

US 2009/0181768 A1 Jul. 16, 2009

(51) Int. Cl.
*A63F 9/24* (2006.01)

(52) U.S. Cl. ..... 463/34; 463/16; 463/17; 463/18; 463/19; 463/20; 463/31; 463/32; 463/33; 273/138.1; 273/138.2; 273/139; 273/143 R; 359/629; 359/630; 359/631; 359/634; 359/639

(58) Field of Classification Search ..... 463/16–20, 463/31–34, 46; 273/138.1, 138.2, 139, 143
See application file for complete search history.

(56) References Cited

U.S. PATENT DOCUMENTS

| | | | | |
|---|---|---|---|---|
| 6,108,064 | A * | 8/2000 | Minoura et al. | 349/130 |
| 7,048,631 | B2 * | 5/2006 | Goins et al. | 463/31 |
| 2005/0153773 | A1 * | 7/2005 | Nguyen et al. | 463/25 |

* cited by examiner

*Primary Examiner* — Sunit Pandya

(57) ABSTRACT

A display system includes a cabinet, a transparent dashboard and a lighting system. The dashboard is fabricated to have at least two refractive indices such that when light from the lighting system is projected therethrough, a unique lighting effect is created.

6 Claims, 2 Drawing Sheets

ILLUMINATED INTERFACE DASHBOARD FOR GAMING MACHINE

TECHNICAL FIELD

The present invention generally relates to an electronic gaming machine and, more particularly, to an electronic gaming machine incorporating an illuminated player interface dashboard.

BACKGROUND

Gaming machines such as mechanically driven slot machines have been a staple of the gaming and entertainment industries for years. Such electronic devices continue to grow in popularity with the development of enhanced computer-generated graphics presented on colorful displays with special sound effects, making them more attractive to a wider audience of participants. The problem that arises, however, is that players quickly tire of a particular game. Accordingly, there is a need in the art for new and innovative concepts associated with electronic gaming machines that serve to continuously attract new participants.

SUMMARY

The present invention relates to a casino-style gaming machine having an illuminated player interface dashboard mounted on the machine's face. The dashboard is fabricated from a relatively thin piece of transparent plastic such as polycarbonate or acrylic, with polished surfaces and edges and openings for allowing access to certain of the machine's components such as a bill acceptor and a ticket printer. Further, various text may be etched into the dashboard to identify the location of the bill acceptor and/or ticket reader or to provide other instructions to the player.

A light source, such as incandescent bulbs, halogen bulbs or light emitting diodes, is positioned along one or more edges of the dashboard. This configuration allows light to pass through the dashboard from edge to edge. The differences in the varying indexes of refraction across the dashboard resulting from the aforementioned opening and etchings cause a unique lighting effect.

Clearly, some alternative embodiments may exhibit advantages and features in addition to, or in lieu of, those mentioned above. It is intended that all such alternative embodiments be included within the scope of the present invention, and be protected by the accompanying claims.

BRIEF DESCRIPTION OF THE DRAWINGS

Many aspects of the invention can be better understood with reference to the following drawings. The components in the drawings are not necessarily to scale. Instead, emphasis is placed upon clearly illustrating the principles of the invention. Moreover, in the drawings, like reference numerals designate corresponding parts throughout the several views.

The various embodiments in accordance with the present invention are generally described below as an illuminated interface dashboard for a gaming machine. For the sake of expediency, the following description generally makes reference to a gaming machine as typically utilized in establishments such as video game parlors and casinos. However, it will be understood that the apparatus described herein are equally pertinent to many other applications, gaming as well as non-gaming, that incorporate an illuminated interface dashboard.

DETAILED DESCRIPTION

The various embodiments in accordance with the invention are generally described below as a gaming machine utilizing an illuminated player interface dashboard for machines. Consequently, for the sake of expedience, the following description mostly refers to gaming systems that are typically utilized in establishments such as casinos and other gaming facilities. However, it will be understood that the methods and systems described herein are equally pertinent to many other applications, gaming as well as non-gaming, that incorporate such a dashboard.

Figure 1:
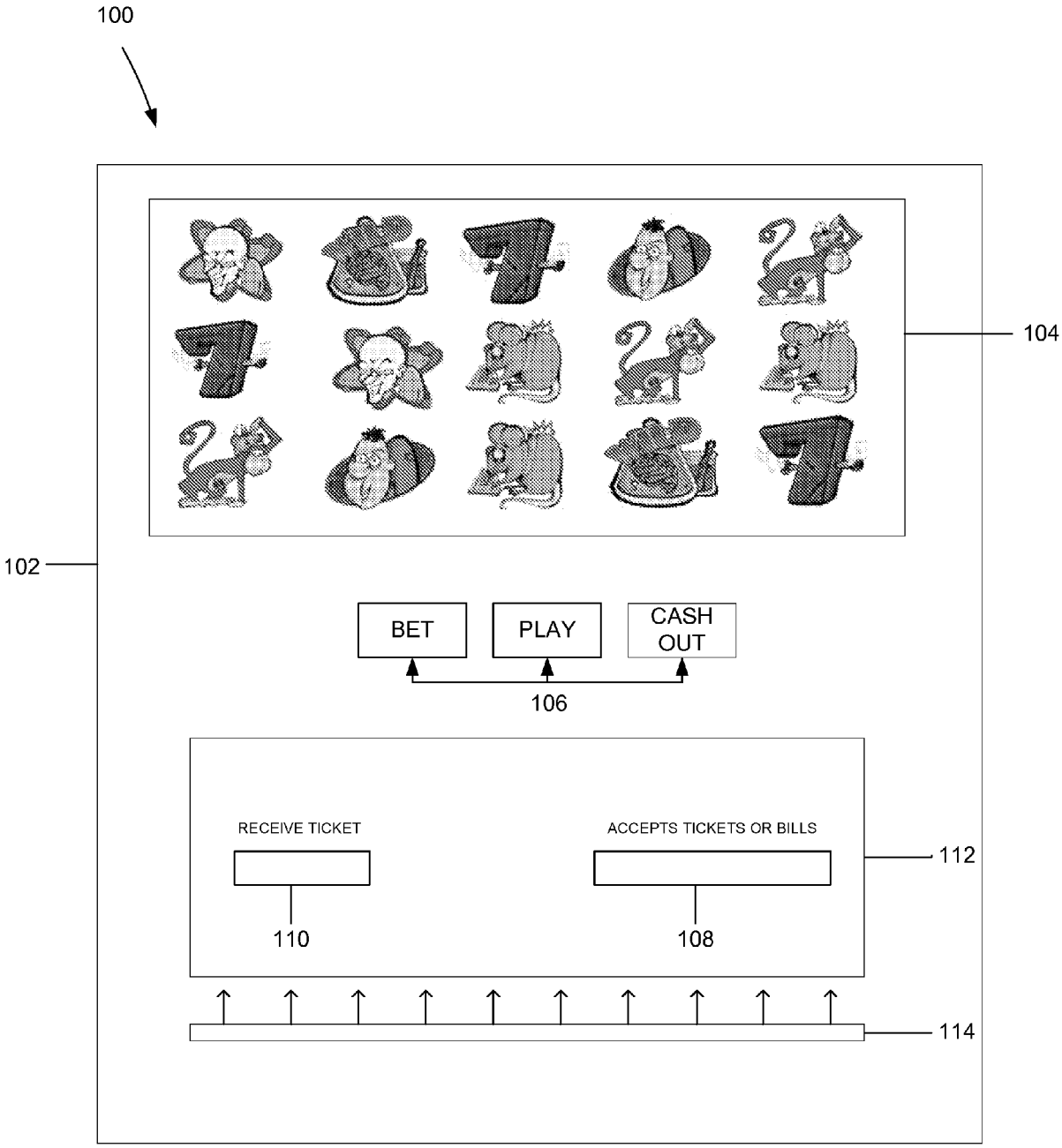
FIG. 1 shows a first exemplary embodiment of a gaming machine incorporating an illuminated player interface dashboard in accordance with the present invention.

FIG. 1 shows an exemplary gaming machine 100 in accordance with the present invention. The gaming machine 100 includes a cabinet 102 housing a display 104 for displaying game events. Typically, the display 104 is a flat panel LCD monitor. However, any display means known in the art may be employed.

Proximate to the display 104 are a series of electromechanical buttons 106 positioned on the cabinet for use as a user interface for controlling game play such as selecting a bet amount, commencing play and cashing out (i.e., terminating game play and retrieving the monetary value corresponding to the remaining game credits). The specific arrangement and function of each of the electromechanical buttons 106 is dependent upon the specific rules of the game being played on the gaming machine 100.

Gaming machine 100 also includes a wager input interface 108, such as a bill acceptor into which a player inserts paper currency and receives credit on the gaming machine 100 for the amount deposited. In alternate embodiments, the wager input interface 108 can be a ticket reader, a magnetic card reader, or similar mechanisms, into which the player places a ticket or magnetic card encoded with a monetary value purchased from a cashier's station or vending machine. In certain embodiments, gaming machine 100 includes a ticket printer 110. In such a system, when a player indicates his or her intent to retrieve any remaining game credits or currency from gaming machine 100, a paper ticket is generated by ticket printer 110. The player may then exchange the ticket for the value printed thereupon or use it for future game play.

Overlaid onto the face of gaming machine 100 is an illuminated player interface dashboard 112 consisting of a clear or colored transparent panel with polished surfaces and edges. Typically, dashboard 112 is a polycarbonate or acrylic material. Mounted along at least one of the edges dashboard 112 is a light projection source 114 arranged to direct light toward the interior of the panel, as further illustrated in FIG. 2.

Figure 2:
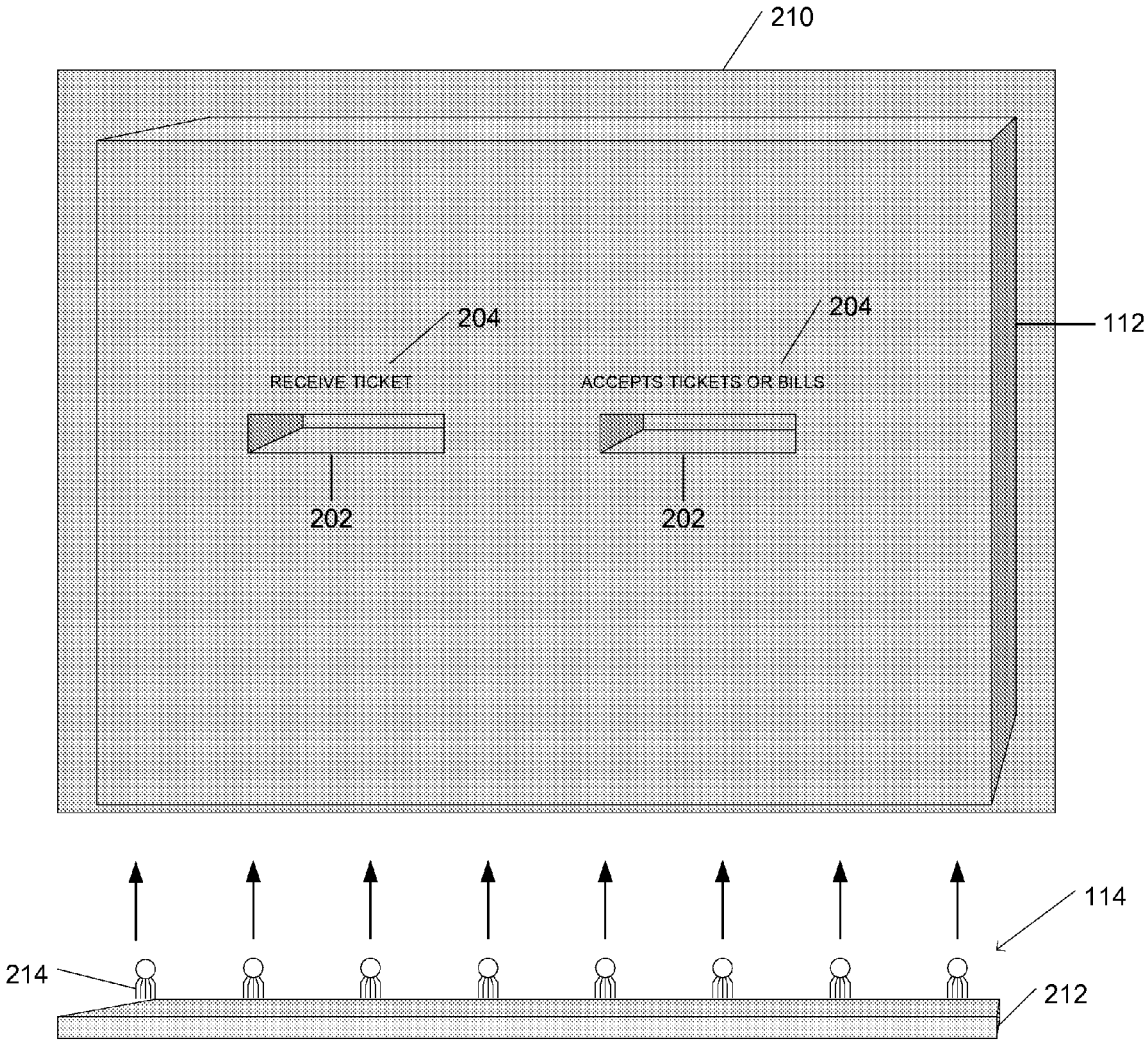
FIG. 2 shows a detailed view of the illuminate player interface dashboard in accordance with the present invention.

Referring to FIG. 2, dashboard 112 has one or more voids 202 that allow access to certain of the components, described above. In one embodiment, voids 202 are positioned so as to align over wager input interface 108 and ticket printer 110. Such a configuration allows the passage of materials such as paper currency and tickets through dashboard 112 to the respective components.

In a further embodiment of the present invention, text 204 may etched into dashboard 112. Alternatively, text 204 may constitute a closed cavity within dashboard 112 with a frosted or opaque surface to enable the refraction and dispersion of white or colored light.

Mounted along at least one of the edges of dashboard 112 is a light projection source 114, comprising a mounting surface 212 and light production means 214, arranged to direct light toward the interior of the dashboard 112. In the preferred embodiment, light production means 214 comprises one or more light emitting diodes, either white or colored, although any light source may be used. In operation, the differences in the varying indexes of refraction across dashboard 112 resulting from the presence of aforementioned voids 202 and/or text 204 opening and etchings creates a unique lighting effect. In one embodiment, a dark-colored opaque panel 210 is positioned directly behind dashboard 112 to enhance the visual effect of the illumination.

It should be understood that the foregoing discussions merely relate to illustrative, exemplary embodiments of the invention. Therefore, it should be further understood that various modifications may be made to the exemplary embodiments herein without departing from the spirit and scope of the invention, which will be apparent to one of ordinary skill in the art in light of the disclosure herein.

We claim:

1. A display system comprising:

a cabinet;

an at least partially transparent interface dashboard mounted on the cabinet comprising i) a first portion having a first refractive index, said first portion corresponding to a flat portion of said dashboard and ii) a second portion having a second refractive index different than the first refractive index;

at least one void corresponding to peripheral device positioned behind said at least one void and accessible by a user via said at least one void, sides of said at least one void corresponding to said second portion having a second refractive index different than the first refractive index, said sides of said at least one void extending from said flat portion into said dashboard; and a lighting system positioned along an edge of the dashboard for propagating light through the dashboard and said edges of said at least one void, said lighting system spaced from said at least one void.

2. The display system of claim 1 wherein the lighting system comprises a plurality of light emitting diodes.

3. The display system of claim 1 wherein the dashboard is fabricated from either a polycarbonate or acrylic material.

4. The display system of claim 1 wherein the second portion comprises an etched area in the dashboard.

5. The display system of claim 1 wherein the second portion comprises an enclosed area within the dashboard.

6. The display system of claim 1 further comprising an opaque panel positioned directly behind the dashboard within the cabinet.

* * * * *